US009362628B2

(12) United States Patent
Yu

(10) Patent No.: US 9,362,628 B2
(45) Date of Patent: Jun. 7, 2016

(54) ANTENNA REFLECTOR APPARATUS

(71) Applicant: SJ ANTENNA DESIGN, Taipei (TW)

(72) Inventor: Ya-Chung Yu, Taipei (TW)

(73) Assignee: SJ ANTENNA DESIGN, Taipei (TW)

( * ) Notice: Subject to any disclaimer, the term of this patent is extended or adjusted under 35 U.S.C. 154(b) by 321 days.

(21) Appl. No.: 14/164,098

(22) Filed: Jan. 24, 2014

(65) Prior Publication Data

US 2014/0225785 A1 Aug. 14, 2014

(30) Foreign Application Priority Data

Feb. 8, 2013 (TW) ..... 102105468 A

(51) Int. Cl.
*H01Q 1/24* (2006.01)
*H01Q 19/10* (2006.01)
*H01Q 13/02* (2006.01)

(52) U.S. Cl.
CPC ..... *H01Q 19/10* (2013.01); *H01Q 1/243* (2013.01); *H01Q 13/02* (2013.01)

(58) Field of Classification Search
CPC ..... H01Q 1/24; H01Q 19/10
USPC ..... 343/702, 834, 841
See application file for complete search history.

(56) References Cited

U.S. PATENT DOCUMENTS 4,783,665 A * 11/1988 Lier ..... H01Q 13/02 343/785
5,486,838 A * 1/1996 Dienes ..... H01Q 17/001 343/781 CA
6,005,528 A * 12/1999 Preiss ..... H01Q 13/0208 333/126
6,750,827 B2 * 6/2004 Manasson ..... H01Q 1/084 343/781 R
2011/0304437 A1 * 12/2011 Beeler ..... H01Q 1/2216 340/10.1

* cited by examiner

*Primary Examiner* — Huedung Mancuso
(74) *Attorney, Agent, or Firm* — Cheng-Ju Chiang

(57) ABSTRACT

According to one aspect of the present invention, an antenna reflector apparatus provided comprises a shell body, a reflector indentation, and an antenna. The reflector indentation embedded in the shell body comprises a first indentation opening and a second indentation opening opposite to the first indentation opening. The first indentation opening is on the first surface of the shell body; the second indentation opening is on the second surface of the shell body. And the first indentation opening penetrates the shell body and connects to the second indentation opening. The antenna is located besides the second indentation opening of the reflector indentation. The area of the first indentation opening of the reflector indentation is larger than the area of the second indentation opening.

15 Claims, 3 Drawing Sheets

ANTENNA REFLECTOR APPARATUS

CROSS REFERENCE TO RELATED APPLICATIONS

This application claims priority under 35 U.S.C 119 to Taiwan patent application No. 102105468, filed on Feb. 8, 2013, the disclosure of which is incorporated herein by reference.

BACKGROUND OF THE INVENTION

1. Field of the Invention

The present invention relates to antenna reflector apparatus, and more particularly, to reflector apparatus which increase signal gain of feed antenna.

2. Description of the Prior Art

While wireless communication systems become more and more popular, wireless communication function is required at more and more applications in order to satisfy consumers' needs. Antenna is an important component used for transmitting and receiving electromagnetic wave in wireless communication system. If antenna is absent, wireless communication system is not capable of transmitting and receiving data. Therefore, antenna is a key component to system performance.

Because electromagnetic energy in 60 GHz band configured to carry high speed audio/video transmission of future mobile communication device is easily absorbed by oxygen particles in the atmosphere, 60 GHz band is limited to short range (less than 10 meters) wireless transmission. This constraint affects data transmission rate and applicable scenarios. As a result, antenna radiation pattern type and efficiency is important in wireless communication system. With respect to applicable scenario of mobile wireless network device, especially smartphone and tablet computer, the antenna radiation pattern types should concurrently cover end-fired and broadside types in order to enlarge wireless communication range and to overcome power attenuation traversing atmosphere.

In general, reflector is used to increase signal gain of antenna. However, most of reflectors used in current mobile devices belong to plane reflector or flat reflector which increases reflected energy of broadside radiation patterned antenna only but does nothing with reflected energy of end-fired radiation patterned antenna. Hence, there exists a need of antenna reflector apparatus which is configured to increase reflected energy of end-fired radiation patterned antenna and signal gain of end-fired radiation patterned antenna.

In conclusion, Applicant provides the present invention, antenna reflector apparatus, for improving and overcoming the pitfalls of prior art.

From the above it is clear that prior art still has shortcomings. In order to solve these problems, efforts have long been made in vain, while ordinary products and methods offering no appropriate structures and methods. Thus, there is a need in the industry for a novel technique that solves these problems.

SUMMARY OF THE INVENTION

The present invention is related to antenna reflector apparatus, which comprises a horn-shaped reflector indentation as a reflection device of a feed antenna for increasing signal gain of the feed antenna.

According to one aspect of the present invention, an antenna reflector apparatus provided comprises a shell body, a reflector indentation, and an antenna. The reflector indentation embedded in the shell body comprises a first indentation opening and a second indentation opening opposite to the first indentation opening. The first indentation opening is on the first surface of the shell body; the second indentation opening is on the second surface of the shell body. And the first indentation opening penetrates the shell body and connects to the second indentation opening. The antenna is located besides the second indentation opening of the reflector indentation. The area of the first indentation opening of the reflector indentation is larger than the area of the second indentation opening.

The above description is only an outline of the technical schemes of the present invention. Preferred embodiments of the present invention are provided below in conjunction with the attached drawings to enable one with ordinary skill in the art to better understand said and other objectives, features and advantages of the present invention and to make the present invention accordingly.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Figure 1:
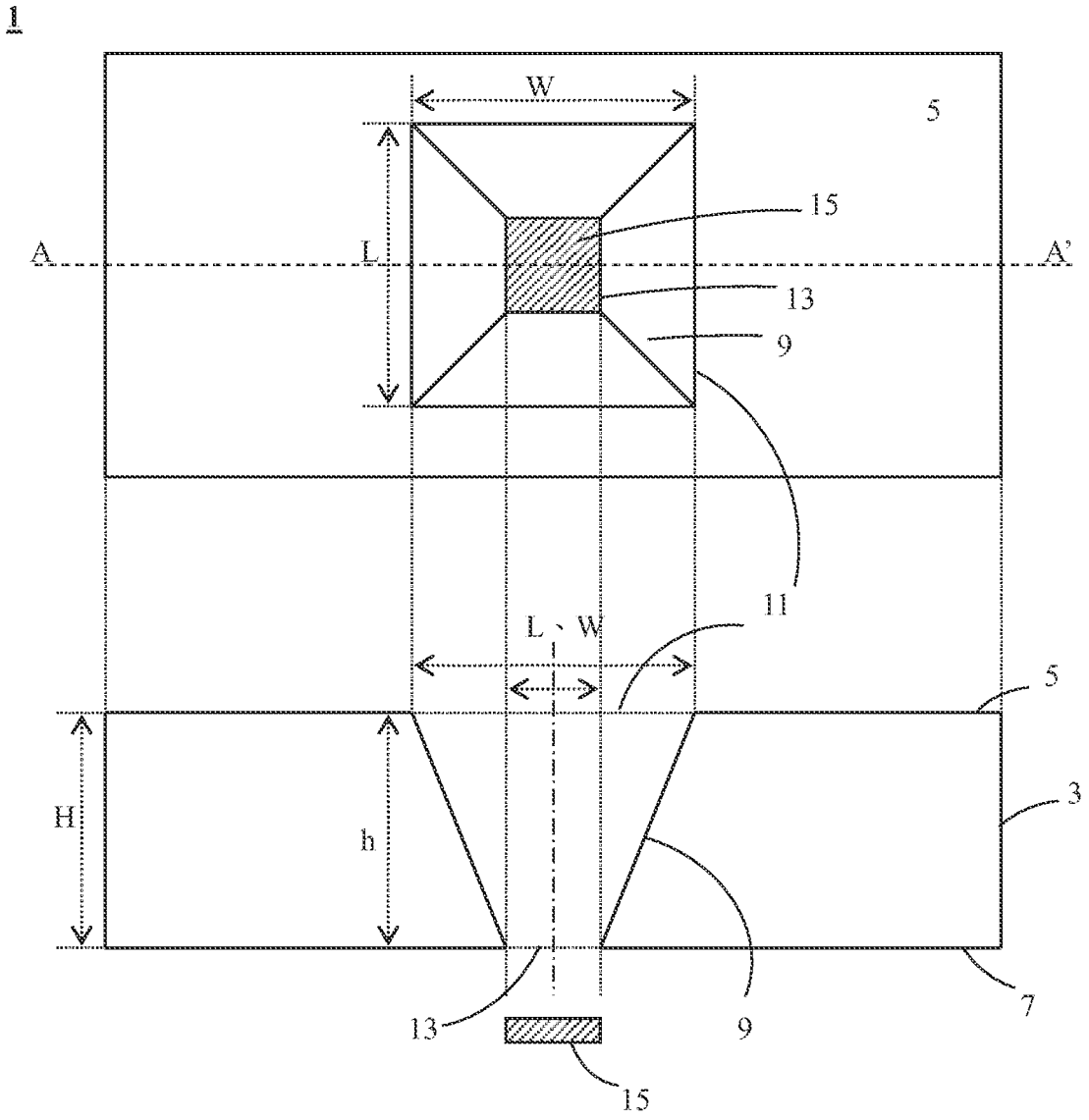
FIG. 1 is a top view diagram of an antenna reflector apparatus in accordance with an embodiment of the present invention and a cross sectional view diagram corresponding to a section line A-A'.

Some embodiments of the present invention are described in details below. However, in addition to the descriptions given below, the present invention can be applicable to other embodiments, and the scope of the present invention is not limited by such, rather by the scope of the claims. Moreover, for better understanding and clarity of the description, some components in the drawings may not necessary be drawn to scale, in which some may be exaggerated relative to others, and irrelevant parts are omitted.

Figure 2:
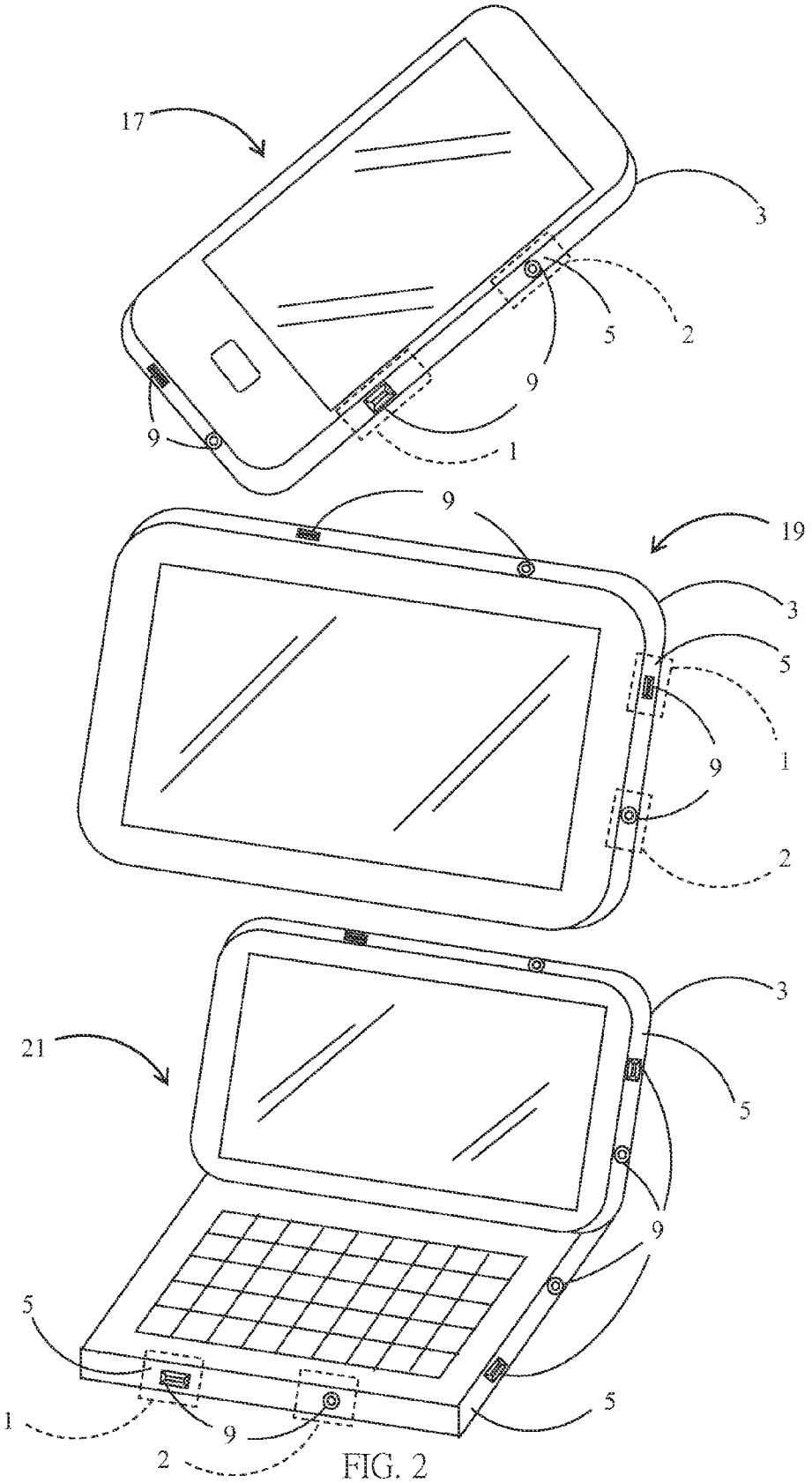
FIG. 2 is a diagram of an antenna reflector apparatus according to a preferred embodiment of the present invention installed in a mobile communication device, a tablet computer, or a notebook computer.

Please refer to FIG. 1, which is a top view diagram of an antenna reflector apparatus in accordance with an embodiment of the present invention and a cross sectional view diagram corresponding to a section line A-A'. As shown in the FIG. 1, the antenna reflector apparatus 1 includes a shell body 3, a reflector indentation 9, and an antenna 15. The shell body 3 has a first surface 5 and a second surface 7 opposite to the first surface 5. The material of the shell body 3 is metal and the thickness H of the shell body 3 is an integer multiple of half wave length. Please also refer to FIG. 2, which is a diagram of an antenna reflector apparatus according to a preferred embodiment of the present invention installed in a mobile communication device, a tablet computer, or a notebook computer. Components with the same numerals in FIG. 1 and FIG. 2 are functionally equivalent. As shown in the FIG. 2, the shell body 3 may be the shell body 3 of a mobile communication device 17, a tablet computer 19, or a notebook computer 21.

As shown in the FIG. 1, the reflector indentation 9 embedded in the shell body 3 comprises a first indentation opening 11 and a second indentation opening 13 opposite to the first indentation opening 13. The first indentation opening 11 is on the first surface 5. And in one embodiment, the shape of the first indentation opening 11 is a rectangle with length L and width W. The length L and the width W both are multiples of half wave length. But the shape of first indentation opening 11 may be different in other embodiments. The second indentation opening 13 is on the second surface 7. And in the embodiment, the shape of the second indentation opening 13 is also another rectangle with length L and width W. The length L and the width W both are multiples of half wave length, too. The shape of second indentation opening 13 may be different in other embodiments. The area of the first indentation opening 11 of the reflector indentation 9 on the first surface 5 of the shell body 3 is larger than the area of the second indentation opening 13 of the reflector indentation 9 on the second surface 7. The first indentation opening 11 of the reflector indentation 9 penetrates the shell body 3 and connects to the second indentation opening 13. The thickness h of the indentation via is as the same as the thickness H of the shell body 3, which is an integer multiple of half wave length. Accordingly, the reflector indentation 9 embedded in the shell body 3 looks like horn. The locations of the reflector indentation 9 of the antenna reflector apparatus 1 embedded on the shell body 3 of the mobile communication device 17, tablet computer 19, or notebook computer 21 are shown in the FIG. 2. However, the embodiments of the present invention do not limit the shape, the number, and the locations to that shown in the FIG. 2.

As shown in the FIG. 1, the antenna 15 is located besides the second indentation opening 13 of the reflector indentation 9. The antenna 15 a feed antenna working at V band. Furthermore, the antenna 15 may be a tapered slot antenna or a Yagi antenna and the center frequency of the antenna 15 equals or exceeds 60 GHz. The radiation pattern of the antenna 15 is end-fired radiation pattern and is parallel to the shell body 3.

Figure 3:
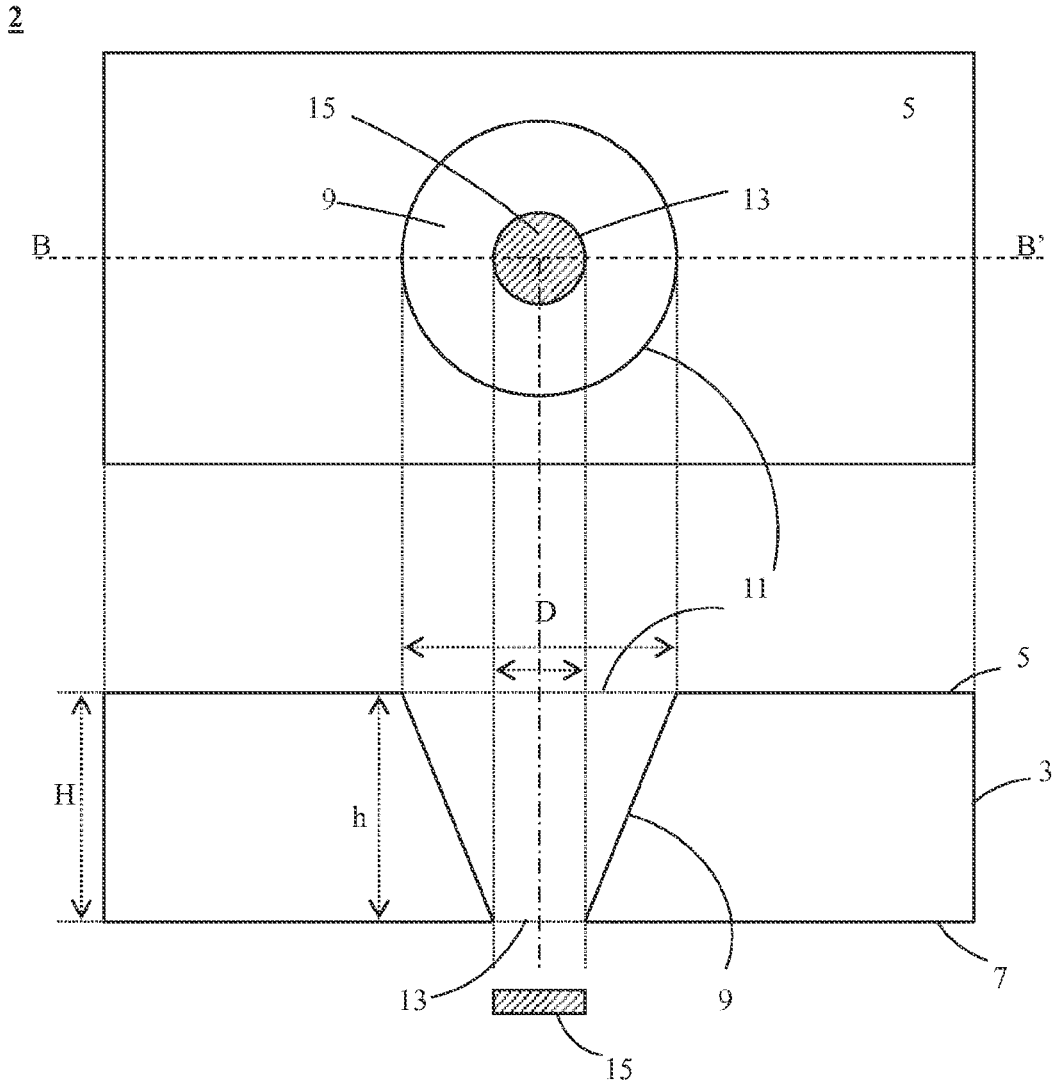
FIG. 3 is a top view diagram of an antenna reflector apparatus in accordance with a preferred embodiment of the present invention and a cross sectional view diagram corresponding to a section line B-B'.

Please refer to FIG. 3, which shows a top view diagram of an antenna reflector apparatus in accordance with a preferred embodiment of the present invention and a cross sectional view diagram corresponding to a section line B-B'. Components with the same numerals in FIG. 1, FIG. 2, and FIG. 3 are functionally equivalent. Referring to FIG. 2 and FIG. 3, the shell body 3 of the antenna reflector apparatus 2 may be the shell body 3 of the mobile communication device 17, the tablet computer 19, or the notebook computer 21. The reflector indentation 9 of the antenna reflector apparatus 2 embedded in the shell body 3 comprises a first indentation opening 11 and a second indentation opening 13 opposite to the first indentation opening 11. The first indentation opening 11 is on the first surface 5 of the shell body 3. And the shape of the first indentation opening 11 is a circle where its diameter is an integer multiple of half wave length. However, the present invention does not take this as its limitation. The second indentation opening 13 is on the second surface 7 of the shell body 3. And the shape of the second indentation opening 13 is a circle where its diameter is also an integer multiple of half wave length. Similarly, the present invention does not take this as its limitation. The area of the first indentation opening 11 of the reflector indentation 9 on the first surface 5 of the shell body 3 is larger than the area of the second indentation opening 13 of the reflector indentation 9 on the second surface 7 of the shell body 3. The first indentation opening 11 penetrates the shell body 3 and connects to the second indentation opening 13. The thickness h of the reflector indentation 9 is as the same as the thickness H of the shell body 3. Accordingly, the reflector indentation 9 embedded in the shell body 3 is horn-shaped. The locations of the reflector indentation 9 of the antenna reflector apparatus 2 embedded on the shell body 3 of the mobile communication device 17, tablet computer 19, or notebook computer 21 are shown in the FIG. 2. However, the embodiments of the present invention do not limit the shape, the number, and the locations to that shown in the FIG. 2.

In summarized, the antenna reflector apparatus in accordance with the present invention comprises a shell body, a reflector indentation, and an antenna. The reflector indentation is embedded in the shell body of a mobile communication device, a tablet computer, or a notebook computer. The reflector indentation comprises a first indentation opening and a second indentation opening opposite to the first indentation opening. And the first indentation opening penetrates the shell body and connects to the second indentation opening. The area of the first indentation opening of the reflector indentation is larger than the area of the second indentation opening. Accordingly, by utilizing the antenna reflector apparatus in accordance with the present invention, it does not need to increase the volume of the feed antenna for promoting reflecting energy. Besides, the horn shaped reflector indentation embedded in the shell body of mobile communication device, tablet computer, or notebook computer indirectly increases reflection area of feed antenna; therefore the signal gain of feed antenna is increased accordingly.

The above embodiments are only used to illustrate the principles of the present invention, and they should not be construed as to limit the present invention in any way. The above embodiments can be modified by those with ordinary skill in the art without departing from the scope of the present invention as defined in the following appended claims.

What is claimed is:

1. An antenna reflector apparatus, comprising:

a shell body, having a first surface and a second surface opposite to the first surface;

a reflector indentation, embedded in the shell body, comprising a first indentation opening and a second indentation opening opposite to the first indentation opening, wherein the first indentation opening is on the first surface of the shell body, the second indentation opening is on the second surface of the shell body, and the first indentation opening penetrates the shell body and connects to the second indentation opening; and an antenna, located besides the second indentation opening of the reflection indentation, wherein the area of the first indentation opening of the reflector indentation on the first surface is larger than the area of the second indentation opening of the reflector indentation on the second surface.

2. The antenna reflector apparatus of claim 1, wherein the material of the shell body is metal.

3. The antenna reflector apparatus of claim 1, wherein the thickness of the shell body is an integer multiple of half wave length.

4. The antenna reflector apparatus of claim 1, wherein the thickness of the reflector indentation is an integer multiple of half wave length.

5. The antenna reflector apparatus of claim 1, wherein the shape of the first and the second indentation opening is a rectangle.

6. The antenna reflector apparatus of claim 5, wherein the length and the width of the first and the second indentation opening is an integer multiple of half wave length.

7. The antenna reflector apparatus of claim 1, wherein the shape of the first and the second indentation opening is a circle.

8. The antenna reflector apparatus of claim 7, wherein the diameter of the first and the second indentation opening is an integer multiple of half wave length.

9. The antenna reflector apparatus of claim 1, wherein the reflector indentation is horn-shaped.

10. The antenna reflector apparatus of claim 1, wherein the antenna is a feed antenna working at V band.

11. The antenna reflector apparatus of claim 1, wherein the antenna is a tapered slot antenna or a Yagi antenna.

12. The antenna reflector apparatus of claim 11, wherein the center frequency of the antenna equals or exceeds 60 GHz.

13. The antenna reflector apparatus of claim 11, wherein the radiation pattern of the antenna is end-fired radiation pattern.

14. The antenna reflector apparatus of claim 11, wherein the radiation pattern of the antenna is parallel to the shell body.

15. The antenna reflector apparatus of claim 1, wherein the shell body is the shell body of a mobile communication device, a tablet computer, or a notebook computer.

* * * * *